United States Patent [19]

Ohashi

[11] Patent Number: 4,990,306

[45] Date of Patent: Feb. 5, 1991

[54] METHOD OF PRODUCING POLAR ANISOTROPIC RARE EARTH MAGNET

[75] Inventor: Ken Ohashi, Fukui, Japan

[73] Assignee: Shin-Etsu Chemical Co., Ltd., Tokyo, Japan

[21] Appl. No.: 437,561

[22] Filed: Nov. 17, 1989

[30] Foreign Application Priority Data

Nov. 18, 1988 [JP] Japan ..... 63-293406

[51] Int. Cl.[5] ..... B22F 3/24

[52] U.S. Cl. ..... 419/28; 419/12; 419/30; 419/38; 419/39; 75/244

[58] Field of Search ..... 75/246, 244 T; 419/12, 419/38, 39, 28, 30; 420/14

[56] References Cited

U.S. PATENT DOCUMENTS

| | | | |
|---|---|---|---|
| 4,600,555 | 7/1986 | Shimizu | 419/5 |
| 4,678,364 | 4/1987 | Charonnat et al. | 404/105 |
| 4,836,868 | 6/1989 | Yajima et al. | 148/302 |
| 4,888,506 | 12/1989 | Umehava | 310/13 |
| 4,888,512 | 12/1989 | Shimizu | 310/156 |

*Primary Examiner*—Stephen J. Lechert, Jr.
*Assistant Examiner*—Nina Bhat
*Attorney, Agent, or Firm*—Sughrue, Mion, Zinn, Macpeak & Seas

[57] ABSTRACT

The invention relates to a method of producing a sintered Nd-Fe-B magnet which has a cylindrical or annular shape and is magnetized in radial directions with polar anisotropic orientation. In a cylindrical mold cavity filled with a Nd-Fe-B magnetic alloy powder a pulse of magnetic field is produced so as to cause polar anisotropic orientation of the magnetic powder with at least six poles distributed around the circumference, and a pulse-like pressure is applied to the powder in the mold cavity to compact the powder into a cylindrically shaped body while the pulse of magnetic field is lasting. The shaped body is sintered, and subsequently the side surface of the sintered body is abraded to remove projecting regions, which are attributed to anisotropic shrinkage during sintering, until the surface becomes accurately cylindrical.

6 Claims, 5 Drawing Sheets

METHOD OF PRODUCING POLAR ANISOTROPIC RARE EARTH MAGNET

BACKGROUND OF THE INVENTION

This invention relates to a method of producing a polar anisotropic rare earth magnet, and more particularly to a method of producing a cylindrical or annular permanent magnet which is magnetized in radial directions and has polar anisotropy by compacting and sintering a magnetic powder essentially composed of Nd, Fe and B. The rare earth permanent magnet is suitable for use in motors for electric and electronic devices.

Several methods have already been proposed for producing sintered, cylindrical or annular permanent magnets with radial orientation or polar anisotropic orientation. For example, in compacting a magnetic powder in a cylindrical mold with a hydraulic press a known method to realize polar anisotropic orientation is arranging several poles of electromagnets around the side wall of the mold, and a known method to realize radial orientation is arranging two electromagnets axially of the mold to interpose the mold therebetween with the same poles of the respective magnets directed toward the mold to utilize repulsion between the magnetic fields. However, these methods have disadvantages such as the need of using large-sized electromagnets, difficulty of varying the number of poles and insufficiency of orientation because of difficulty in producing magnetic fields of desirably high intensity.

In the case of producing a plastic magnet by injection molding the magnetic powder in the melted resin can be oriented to a sufficiently high degree by applying magnetic fields of relatively low intensity. However, because of containing a binding resin which is a nonmagnetic material plastic anisotropic magnets are inferior to sintered anisotropic magnets in magnetic characteristics.

It is well known that a magnetic field of very high intensity and very short duration, viz. a pulse of magnetic field, can be produced by instantaneously supplying a large current to a coil from a capacitor. For producing a polar anisotropic magnet, JP-A 59-216453 proposes to repeatedly apply a pulse of magnetic field to the magnetic powder under compression with a static press means such as a hydraulic press to thereby induce polar anisotropic orientation. However, by this method the orientation becomes disordered because the duration of each pulse of magnetic field is far shorter than the duration of pressing and also because the magnetic field can be produced only intermittently during the compressing process.

In view of the above problems, we have already proposed to use a pulse of magnetic field and a pressure pulse in combination for shaping a magnetic powder into a cylindrical green body with polar anisotropic orientation. (JP-A 58-157901, JP-A 61-243102 and JP-A 61-241905.) However, in the case of producing a polar anisotropic rare earth magnet essentially composed of Nd, Fe and B, there is another problem which is attributed to anisotropy of shrinkage of the sintered magnet body. That is, the sintered body exhibits a greater amount of shrinkage in the direction of magnetization than in the direction perpendicular thereto. Therefore, when an annular green body is sintered the sintered body has dents and projections on its side surface and hence, with exaggeration, has a petaloid shape in plan view. With such deviation from an annular shape the magnet can hardly be used in rotating machines.

SUMMARY OF THE INVENTION

It is an object of the present invention to provide a method of producing a polar anisotropic rare earth permanent magnet composed essentially of Nd, Fe and B, which magnet has an accurately cylindrical or annular shape and suitable for use in motors in electric or electronic devices.

The present invention provides a method of producing a polar anisotropic rare earth magnet which has a cylindrical or annular shape and is magnetized in radial directions, the method comprising the steps of packing a magnetic alloy powder essentially composed of Nd, Fe and B in a cylindrical or annular cavity of a mold, producing a single pulse-like magnetic field in the mold cavity so as to cause polar anisotropic orientation of the magnetic powder with at least six poles distributed around the outer circumference of the mold cavity, applying a pulse-like impactive pressure to the magnetic powder in the mold cavity such that the magnetic powder is compacted into a cylindrically or annularly shaped body while the pulse of magnetic field is lasting, sintering the shaped body, and abrading the side surface of the sintered body to remove projecting regions of the side surface until the side surface becomes accurately cylindrical.

By the method according to the present invention a sufficiently high degree of polar anisotropic orientation of the magnetic powder is accomplished very orderly since the compaction of the magnetic powder is performed while the magnetic field for orientation exists without interruption. Preferably the application of the pulse-like pressure to the magnetic powder is started a short time behind the rise of the pulse of magnetic field. In this invention the anisotropic shrinkage of the sintered magnet body is remedied by the subsequent abrading operation.

DESCRIPTION OF THE PREFERRED EMBODIMENTS

Figure 1:
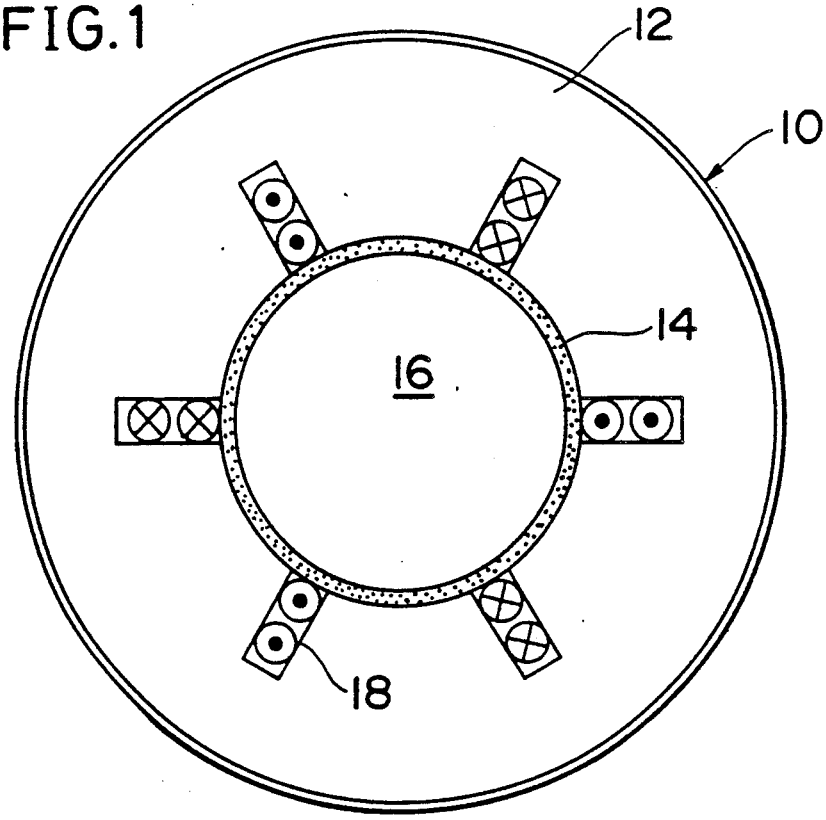
FIG. 1 is a schematic cross-sectional view of a mold for use in an embodiment of the invention.

FIG. 1 shows a mold 10 for producing a solid cylindrical magnet by a method according to the invention. Essentially the mold 10 is made up of a cylindrical yoke 12 made of iron, a sleeve 14 which is made of a nonmagnetic material such as tungsten carbide and shrinkage-fitted in the cylindrical yoke 12 and electromagnets 18 disposed in the yoke 12 so as to provide six poles around the periphery of the sleeve 14 0 at equal angular intervals. The space 16 in the sleeve 14 is used as a die cavity for compressing a rare earth magnetic powder into a cylindrical body while maintaining a pulse of magnetic field for orientation of the magnetic powder toward the six poles around the circumference.

Figure 2:
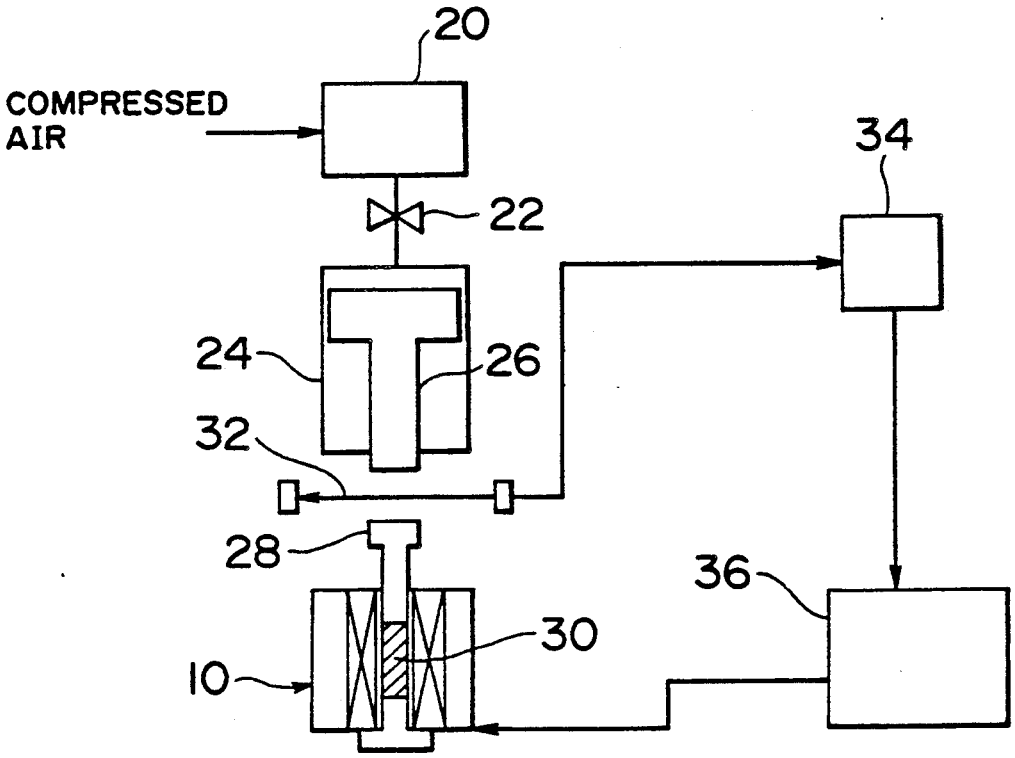
FIG. 2 is a diagram showing an outline of an apparatus for a method according to the invention.

FIG. 2 shows an outline of an apparatus for orienting and compacting a magnet powder 30 in the mold 10. The apparatus includes an accumulator 20 in which compressed air is reserved and a pneumatic shock generator 24 located above the mold 10. By manipulating a regulator valve 22, compressed air at a desired pressure is supplied to the shock generator 24 to thrust a hammer 26 downward. The hammer 26 strikes at an upper punch 28 of the mold 10 whereby a compressive pressure pulse is applied to the magnetic powder 30. Before striking at the punch 28 the hammer 26 traverses a light beam 32, and this is signaled to a delay pulser 34. Then, with a predetermined slight delay the delay pulser 34 commands a capacitor bank 36, which has been charged, to make instantaneous discharge to apply a pulse of a large current to the electromagnets in the mold 10 to thereby produce a pulse of magnetic field in the magnet powder 30.

Figure 3:
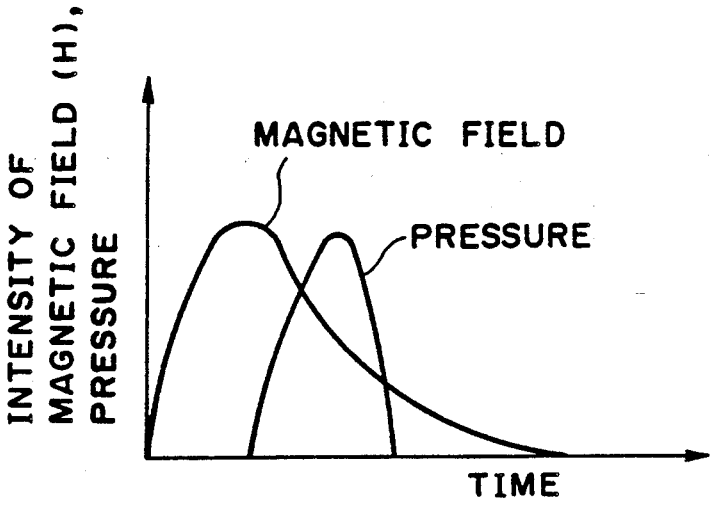
FIG. 3 is a graph showing the timing of a pressure pulse and a magnetic field pulse used in a method according to the invention.
Figure 4:
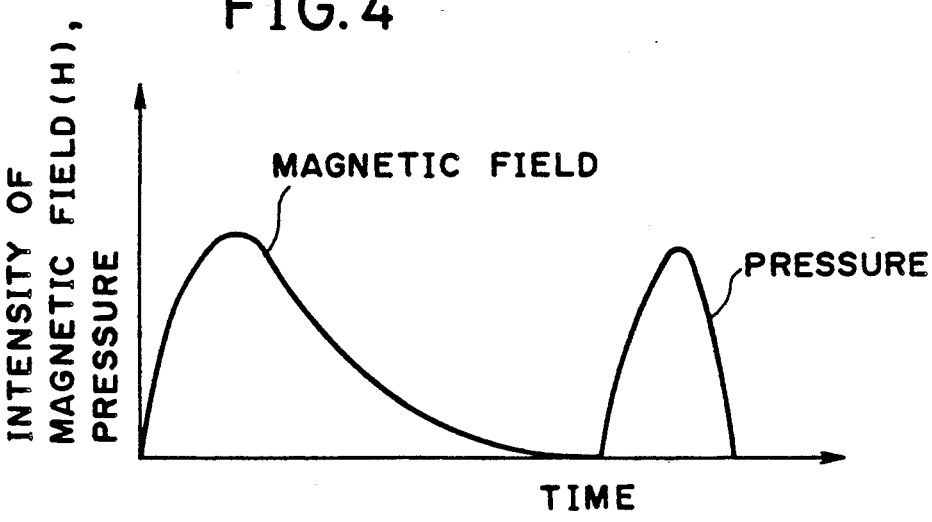
FIG. 4 is a graph showing undesirable timing of the pressure pulse and the magnetic field pulse.

Referring to FIG. 3, the pulse of magnetic field is generated at such timing that the pressure pulse is produced slightly afterward, and the duration of the pulse of magnetic field is made relatively long so that the pressure pulse decays earlier. That is, it is necessary to complete the compaction of the magnetic powder 30 in the mold 10 while the magnetic field is lasting. Referring to FIG. 4, even if the pressure pulse for compacting the magnet powder 30 is produced after vanishment of the pulse of magnetic field it is possible to obtain a green body with polar anisotropic orientation, but the compaction in the absence of magnetic field results in lowering of the degree of orientation and consequential unsatisfactoriness of the magnetic characteristics of the sintered magnet.

Figure 5:
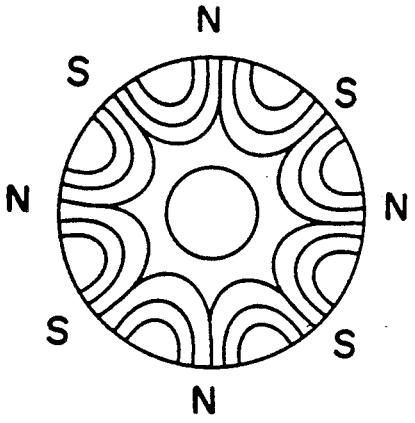
FIG. 5 is an explanatory illustration of magnetic orientation in a green body prepared by a method of the invention.

FIG. 5 shows the pattern of polar anisotropic orientation in an annular green body prepared by the above described method according to the invention. However, attention should be directed to the fact that when the material of the green body is a rare earth magnetic alloy essentially composed of Nd Fe and B there is anisotropy in shrinkage of the body during sintering. That is, the amount of shrinkage is larger in the direction of magnetization than in the direction perpendicular to the direction of magnetization. For example, in producing a sintered magnet of Nd(33%)-Fe(75.7%)-B(1.3%) in Example 1 of the invention described hereinafter, the length or diameter of the sintered body (density: 7.41 g/cm$^3$) on the basis of the length or diameter of the green body (density: 4.0 g/cm$^3$) was 75% in the direction of magnetization and 84% in the direction perpendicular to the direction of magnetization.

Figure 6:
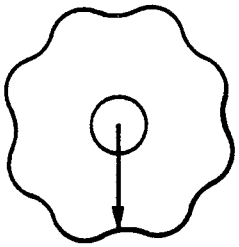
FIG. 6 is an explanatory plan view of a sintered body prepared in a method of the invention.
Figure 7:
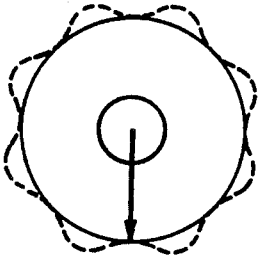
FIG. 7 shows the manner of abrading the side surface of the sintered body of FIG. 6.
Figure 8:
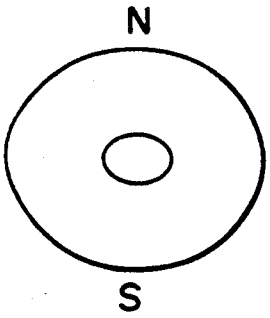
FIGS. 8 and 9 are explanatory plan views of two sintered magnet bodies obtained by methods not in accordance with the invention, respectively.
Figure 9:
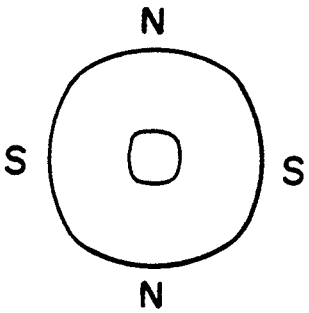

Therefore, a polar anisotropic Nd-Fe-B magnet produced by sintering a cylindrical green body has dents and projections in its cylindrical surface, as illustrated in FIG. 6 with exaggeration. For example, in the case of eight-pole anisotropy there are eight dents. In the present invention, such deformation is remedied by machining the sintered magnet body with a suitable abrading machine such as a centerless grinder to remove the projections, as illustrated in FIG. 7 in broken line, until the magnet body has an accurately cylindrical surface. The removal of the projecting regions has no influence on the open flux of the magnet because each of the projecting regions is between two poles. However, excessive abrasion results in lowering of open flux. It suffices to make abrasion to the extent of the radius (indicated by arrow in FIGS. 6 and 7) of the dented regions, viz. pole regions. In the case of a cylindrical or annular magnet having two poles (FIG. 8) or four poles (FIG. 9) the degree of deformation by the shrinkage during sintering is so great, as illustrated in FIGS. 8 and 9, that the correction by machining becomes difficult. Considering this matter, in the present invention the minimum number of poles in the anisotropic magnet is specified to be six.

Figure 10:
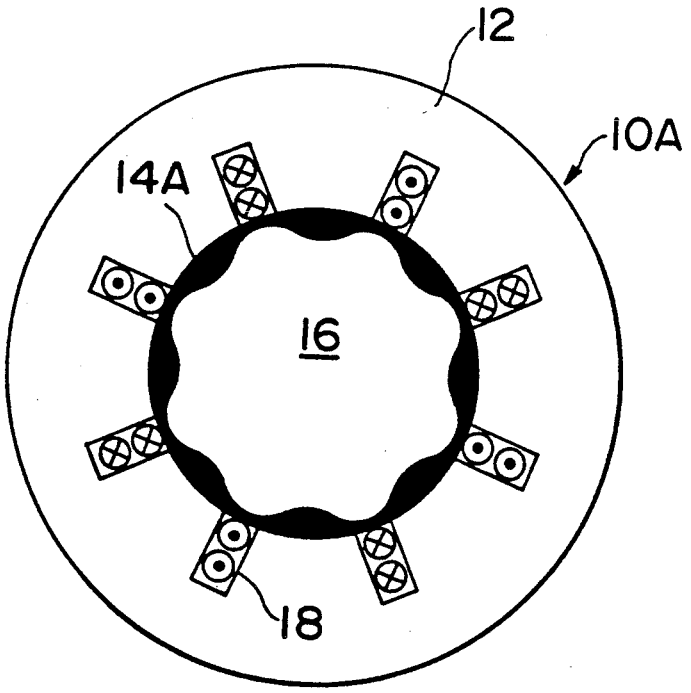
FIG. 10 is a schematic cross-sectional view of another metal mold which can be used in the invention.

It is possible to omit or greatly reduce the post-sintering abrasion operation to obtain a polar anistotropic Nd-Fe-B magnet of an accurately cylindrical shape by modifying the mold of FIG. 1 in the manner as shown in FIG. 10. In the mold 10A of FIG. 10 the inner surface of the sleeve 14A fitted in the iron yoke 12 is formed with radially inward projections in the regions between the poles. Accordingly the green body formed in this mold 10A has radially outward projections in the regions of the respective poles, and when the green body is sintered the projections disappear as a consequence of the anisotropic shrinkage. However, the sleeve 14A of such an intricate shape is not easy to manufacture and raises the cost of the mold.

The raw material for the present invention is a powder of a rare earth magnetic alloy essentially composed of Nd, Fe and B. However, for improving the magnetic characteristics it is possible, as is known, to substitute small portions of the essential components by additives selected from, for example, Co, Al. Nb, Ga, Pr, Dy and Tb.

EXAMPLE 1

A mixture of 33 wt % of Nd (99% purity), 75.7 wt % of Fe (99.9% purity) and 1.3 wt % of B (99.5% purity) was melted in an inactive gas atmosphere in a high-frequency induction furnace, and the molten metal was poured into a water-cooled copper mold to obtain an alloy ingot. In a ball mill the ingot was pulverized in a wet state to obtain a magnetic alloy powder having a mean particle size of 3 μm.

Using the six-pole anisotropic mold 10 of FIG. 1, the cavity 16 was packed with the Nd-Fe-B magnetic alloy powder. With the apparatus of FIG. 2, a pulse of magnetic field was produced to orient the magnetic powder in the mold 10 in toward the respective poles. The rise time of the pulse was 1 ms, and the peak intensity of the magnetic field was 15 kOe. Then the magnetic powder was compressed into a cylindrical green body by a pressure pulse produced 2 ms behind the rise of the pulse of magnetic field. The pressure pulse had a peak of 1200 kg/cm$^2$ and decayed while the magnetic field was remaining.

To examine the amount of shrinkage during sintering, in a separate mold the same magnetic alloy powder was radially oriented by producing a static magnetic field of 10 kOe and then compressed into a green body by application of a static pressure of 1000 kg/cm$^2$ (with a hydraulic press) in the direction perpendicular to the direction of the magnetic field.

The both green bodies were sintered in vacuum at 1080° C. for 2 hr, and the sintered bodies were subjected to heat treatment at 950° C. for 1 hr and then at 550° C. for 1 hr and thereafter quenched.

Figure 11:
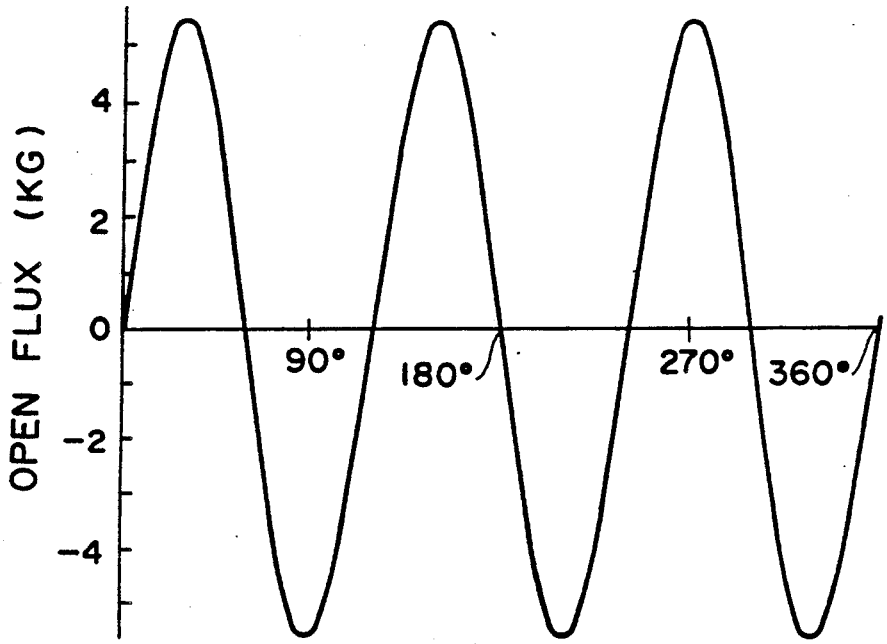
FIGS. 11 and 12 are graphs showing the results of measurement of open flux on cylindrical magnets produced in examples of the invention.

The result of measurement of the amount of shrinkage was as described hereinbefore. The sintered body obtained from the green body with polar anisotropic orientation had a petaloid shape as illustrated in FIG. 6. The side surface of this sintered body was abraded with a centerless grinder to remove the projecting regions until the surface became cylindrical. After that, the cylindrical body was magnetized into a six-pole magnet by a pulse of magnetic field, and open flux of the obtained magnet was measured around its circumference by holding a Hall effect IC (integrated circuit) to the cylindrical surface. The result is shown in FIG. 11. For comparison, another sample of the sintered body was similarly magnetized without abrading the deformed side surface and subjected to measurement of open flux. As a result it was evidenced that the abrading operation had no influence on the open flux of the magnet.

EXAMPLE 2

Using a mixture of 30 wt % of Nd (99% purity), 3 wt % of Dy (99% purity), 69 wt % of Fe (99.9% purity), 5.1 wt % of Co (99.9% purity), 1.1 wt % of B (99.5% purity) and 1 wt % of Al (99.9% purity) as the raw material, a cylindrical polar anisotropic magnet with ten poles was produced by the same process and under the same conditions as in Example 1 except for the use of a ten-pole anisotropic mold in place of the mold in Example 1.

For comparison, a cylindrical isotropic magnet of the same composition was produced by the same method except that no magnetic field was produced for the magnetic alloy powder in the mold.

Figure 12:
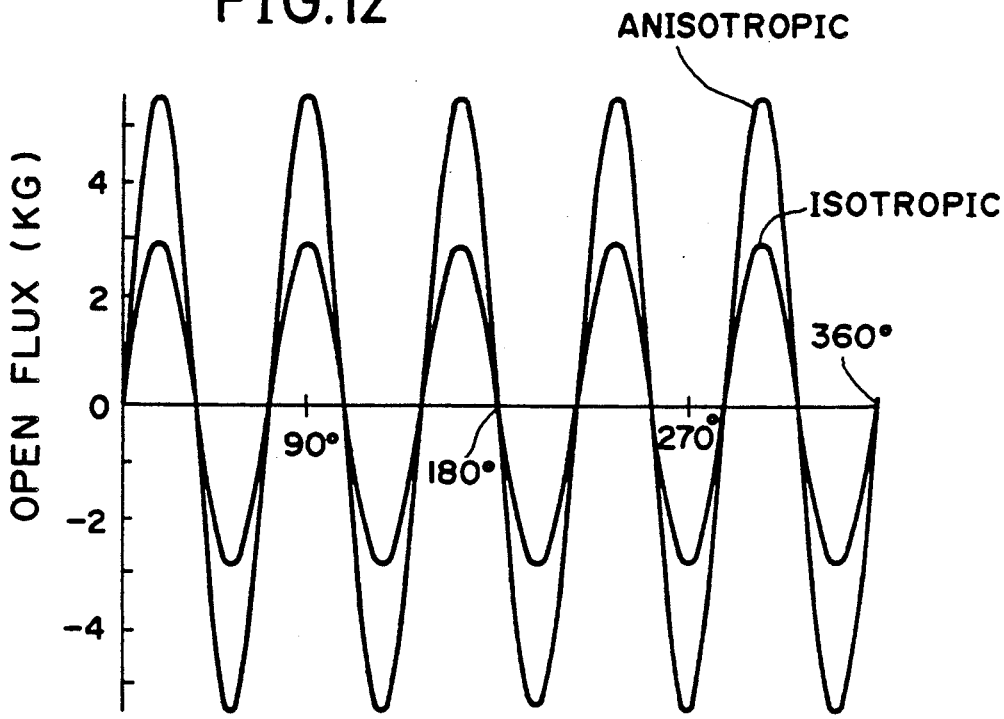

Both the anisotropic magnet and the isotropic magnet were subjected to measurement of open flux around the cylindrical surface. The results are shown in FIG. 12. As can be seen in FIG. 12, the open flux of of the polar anisotropic magnet was about two times as high as that of the isotropic magnet. The difference was evidently attributed to the existence of high degree of orientation in the anisotropy magnet.

What is claimed is:

1. A method for producing a polar anisotropic rare earth magnet having a cylindrical or annular shape and magnetized in radial directions, the method comprising the steps:

packing a magnetic alloy powder essentially composed of Nd, Fe and B in a cylindrical or annular cavity of a mold;

producing a single pulse-like magnetic filed in the mold cavity so as to cause polar anisotropic orientation of said magnetic alloy powder with at least six poles distributed around the outer circumference of the cavity;

after producing said pulse-like magnetic field, applying an impactive and pulse-like pressure to the magnetic alloy powder in the mold cavity such that the powder is compacted into a cylindrically or annularly shaped body while said pulse-like magnetic filed is lasting;

sintering said shaped body; and before magnetizing the sintered body, abrading the side surface of the sintered body to remove projecting regions of the side surface attributed anisotropic shrinkage during sintering until the side surface becomes accurately cylindrical.

2. A method according to claim 1, wherein the duration of said pulse-like pressure is shorter than the duration of said pulse-like magnetic field.

3. A method according to claim 1, wherein said pulse-like pressure is produced by striking at a punch coaxially fitted in said mold cavity.

4. A method according to claim 1 wherein the cylindrical inner surface of said mold defining said cavity is formed with a radially inward projection in each pole region so as to compensate for anisotropic shrinkage of said shaped body during sintering.

5. A method according to claim 1, wherein said magnetic alloy powder is a powder of a ternary alloy of Nd, Fe and B.

6. A method according to claim 1, wherein said magnetic alloy powder is a powder of an alloy of Nd, Fe, B and at least one supplementary metal selected from the group consisting of Co, Al, Nb, Ga, Pr, Dy and Tb.

* * * * *

UNITED STATES PATENT AND TRADEMARK OFFICE

CERTIFICATE OF CORRECTION

PATENT NO. : 4,990,306

DATED : February 5, 1991

INVENTOR(S) : Ken Ohashi

It is certified that error appears in the above-identified patent and that said Letters Patent is hereby corrected as shown below:

Column 3, line 11, after "14", delete "0".

Column 6, line 11, delete "filed", and insert --field--;

Column 6, line 21, delete "filed", and insert --field--.

Signed and Sealed this

Fifteenth Day of September, 1992

*Attest:*

DOUGLAS B. COMER

*Attesting Officer*

*Acting Commissioner of Patents and Trademarks*